US008845861B2

(12) United States Patent
Jackson et al.

(10) Patent No.: US 8,845,861 B2
(45) **Date of Patent: *Sep. 30, 2014**

(54) OPTICAL BRIGHTENING COMPOSITIONS

(75) Inventors: Andrew Clive Jackson, Muenchenstein BL (CH); David Puddiphatt, Grellingen BL (CH); Cédric Klein, Brumath (FR)

(73) Assignee: Clariant Finance (BVI) Limited, Tortola (VG)

( * ) Notice: Subject to any disclaimer, the term of this patent is extended or adjusted under 35 U.S.C. 154(b) by 157 days.

This patent is subject to a terminal disclaimer.

(21) Appl. No.: 12/934,161

(22) PCT Filed: Mar. 12, 2009

(86) PCT No.: PCT/EP2009/052921

§ 371 (c)(1),
(2), (4) Date: Mar. 7, 2011

(87) PCT Pub. No.: WO2009/118248

PCT Pub. Date: Oct. 1, 2009

(65) Prior Publication Data

US 2011/0146929 A1 Jun. 23, 2011

(30) Foreign Application Priority Data

| | | |
|---|---|---|
| Mar. 26, 2000 | (EP) | 08102906 |
| Dec. 10, 2008 | (EP) | 08171223 |
| Dec. 12, 2008 | (EP) | 08171480 |

(51) Int. Cl.

| | |
|---|---|
| ***D21H 21/16*** | (2006.01) |
| ***D21H 21/30*** | (2006.01) |
| ***D21H 17/66*** | (2006.01) |
| ***D21H 17/63*** | (2006.01) |

(52) U.S. Cl.

CPC ..... *D21H 17/63* (2013.01); *D21H 17/66* (2013.01); *D21H 21/30* (2013.01); *D21H 21/16* (2013.01)

USPC ..... 162/162; 162/135; 162/175; 162/181.2; 427/158; 106/206.1; 106/286.6; 252/301.23

(58) Field of Classification Search

CPC ..... D21H 17/63; D21H 17/66; D21H 21/16; D21H 21/30; D21H 19/12; D21H 19/18; D21H 17/07; D21H 17/09; D21H 17/74; D21H 19/54; C07D 251/68

USPC ..... 162/135, 158, 162, 175, 181.1, 181.2; 252/301.16, 301.21, 301.23; 8/648; 427/158; 106/286.6, 206.1, 209.1, 106/214.1, 217.2; 534/571, 689; 562/51

See application file for complete search history.

(56) References Cited

U.S. PATENT DOCUMENTS

| | | | | |
|---|---|---|---|---|
| 3,728,275 | A | 4/1973 | Horlacher et al. | |
| 3,970,647 | A | 7/1976 | Balzer et al. | |
| 4,466,900 | A * | 8/1984 | Horlacher et al. | 252/301.23 |
| 4,764,176 | A | 8/1988 | Sakamoto | |
| 5,873,913 | A * | 2/1999 | Cowman et al. | 8/648 |
| 6,207,258 | B1 * | 3/2001 | Varnell | 428/32.1 |
| 6,890,454 | B2 | 5/2005 | Farrar et al. | |
| 7,060,201 | B2 | 6/2006 | Farrar | |
| 7,198,731 | B2 | 4/2007 | Jackson | |
| 7,270,771 | B2 * | 9/2007 | Cuesta et al. | 252/301.23 |

(Continued)

FOREIGN PATENT DOCUMENTS

| | | |
|---|---|---|
| CA | 2553556 | 10/2005 |
| EP | 1763519 | 3/2007 |
| GB | 1140415 | 1/1969 |
| GB | 1239818 | 7/1971 |

(Continued)

OTHER PUBLICATIONS

PCT International Search Report for PCT/EP 2009/052921, mailed Sep. 17, 2009.

English Abstract for JP 62106965, May 18, 1987.

Lanier, "Properties and evaluation of fluorescent brightening agents," J. Soc'y of Dyers and Colourists 82:4 (1966), p. 125-132.

*Primary Examiner* — Eric Hug

(74) *Attorney, Agent, or Firm* — Miles & Stockbridge, P.C.

(57) ABSTRACT

A sizing composition for paper, characterised in that the sizing composition comprises (a) at least one optical brightener of formula (1), (1)

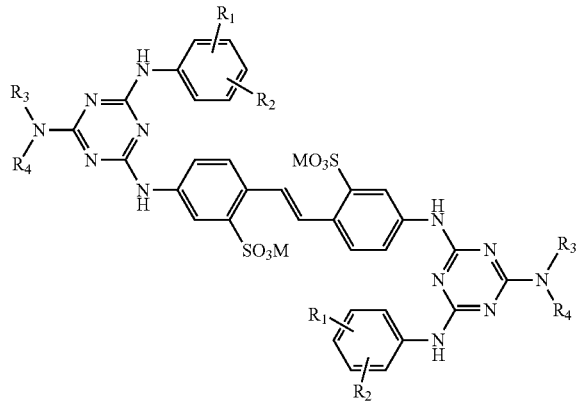

(b) a magnesium salt; and (c) a binding agent, which is selected from the group consisting of native starch, enzymatically modified starch and chemically modified starch;

0.1 to 15 parts of component (b) being present per part of component (a).

20 Claims, No Drawings

(56) References Cited

U.S. PATENT DOCUMENTS

| | | | | |
|---|---|---|---|---|
| 7,812,156 | B2 | 10/2010 | Jackson et al. | |
| 8,361,571 | B2 * | 1/2013 | Tan et al. | 428/32.21 |
| 2003/0089888 | A1 * | 5/2003 | Bacher et al. | 252/301.21 |
| 2005/0022320 | A1 * | 2/2005 | Jackson | 8/516 |
| 2006/0055762 | A1 * | 3/2006 | Ushiku et al. | 347/105 |
| 2007/0245503 | A1 | 10/2007 | Jackson et al. | |
| 2007/0277950 | A1 * | 12/2007 | Skaggs et al. | 162/162 |
| 2008/0066878 | A1 * | 3/2008 | Nguyen | 162/24 |
| 2011/0168343 | A1 | 7/2011 | Jackson et al. | |

FOREIGN PATENT DOCUMENTS

| | | |
|---|---|---|
| GB | 1526004 | 9/1978 |
| JP | 62106965 | 5/1987 |
| WO | WO 96/00221 | 1/1996 |
| WO | WO 98/42685 | 10/1998 |
| WO | WO 03/044275 | 5/2003 |
| WO | WO 2006/000573 | 1/2006 |

* cited by examiner

OPTICAL BRIGHTENING COMPOSITIONS

The instant invention relates to compositions which provide superior optical brightening effects when applied to the surface of paper at the size-press.

BACKGROUND

A high level of whiteness is an important parameter for the end-user of paper products. The most important raw materials of the papermaking industry are cellulose, pulp and lignin which naturally absorb blue light and therefore are yellowish in color and impart a dull appearance to the paper. Optical brighteners are used in the papermaking industry to compensate for the absorption of blue light by absorbing UV-light with a maximum wavelength of 350-360 nm and converting it into visible blue light with a maximum wavelength of 440 nm.

In the manufacture of paper, optical brighteners may be added either at the wet end of the paper machine, or to the surface of paper, or at both points. In general, it is not possible to achieve the whiteness levels required of higher-quality papers by addition at the wet end alone.

A common method of adding optical brightener to the surface of paper is by application of an aqueous solution of the optical brightener at the size-press together with a sizing agent, typically a native starch or an enzymatically or chemically modified starch. A preformed sheet of paper is passed through a two-roll nip, the entering nip being flooded with sizing solution. The paper absorbs some of the solution, the remainder being removed in the nip.

In addition to starch and optical brightener, the sizing solution can contain other chemicals designed to provide specific properties. These include defoamers, wax emulsions, dyes, pigments and inorganic salts.

In order to reach higher whiteness levels, considerable effort has been put into the development of new optical brighteners. See, for example, Japanese Kokai 62-106965, PCT Application WO 98/42685, U.S. Pat. No. 5,873,913 and European Patent 1,763,519.

GB 1 239 818 discloses hexasulphonated optical brighteners derived from triazinylaminostilbenes. Examples 1 to 6 disclose their sodium salts. Magnesium is only mentioned in a list of possible counterions for the hexasulphonated optical brighteners, starch as a component in a surface sizing composition is also only mentioned in a list of possible binding agents.

The demand remains for more efficient means of achieving high whiteness levels in paper.

DESCRIPTION OF THE INVENTION

Surprisingly, we have found that optical brighteners of formula (1) when applied to the surface of paper in combination with magnesium salts in a starch sizing composition give enhanced whitening effects. Parts mean parts by weight in the following, if not otherwise specified.

The present invention therefore provides a method for brightening paper in the size-press, characterised in that the sizing composition comprises (a) at least one optical brightener of formula (1)

(1)

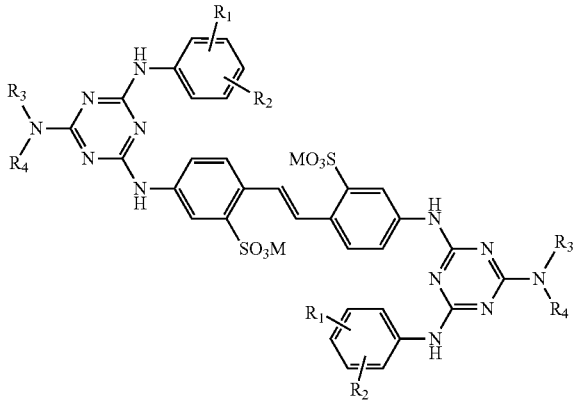

in which $R_1$ is hydrogen or $SO_3M$, $R_2$ is hydrogen or $SO_3M$, $R_3$ is hydrogen, $C_{1-4}$ alkyl, $C_{2-3}$ hydroxyalkyl, $CH_2CO_2M$, $CH_2CH_2CONH_2$ or $CH_2CH_2CN$, $R_4$ is $C_{1-4}$ alkyl, $C_{2-3}$ hydroxyalkyl, $CH_2CO_2M$, $CH(CO_2M)CH_2CO_2M$ or $CH(CO_2M)CH_2CH_2CO_2M$, benzyl, or $R_3$ and $R_4$ together with the neighbouring nitrogen atom signify a morpholine ring, and M is hydrogen, an alkali metal cation, ammonium, monomethyl-di-$C_2$-$C_3$-hydroxyalkyl ammonium, di-methyl-mono-$C_2$-$C_3$-hydroxyalkyl ammonium, ammonium which is mono-, di- or trisubstituted by a $C_2$-$C_3$ hydroxyalkyl radical, or mixtures of said compounds, (b) a magnesium salt; and (c) a binding agent, which is selected from the group consisting of native starch, enzymatically modified starch and chemically modified starch;

0.1 to 15 parts of component (b) being present per part of component (a).

Preferred compounds of formula (1) are those in which $R_3$ represents hydrogen, methyl, ethyl, n-propyl, isopropyl, β-hydroxyethyl, β-hydroxypropyl, $CH_2CO_2M$, $CH_2CH_2CONH_2$ or $CH_2CH_2CN$ and $R_4$ represents methyl, ethyl, n-propyl, isopropyl, 2-butyl, β-hydroxyethyl, β-hydroxypropyl, $CH_2CO_2M$, $CH(CO_2M)CH_2CO_2M$, $CH(CO_2M)CH_2CH_2CO_2M$ or benzyl.

Optical brighteners of formula (2) and (3) are specific examples for the optical brighteners of formula (1), but the invention is not limited to these two specific examples.

(2)

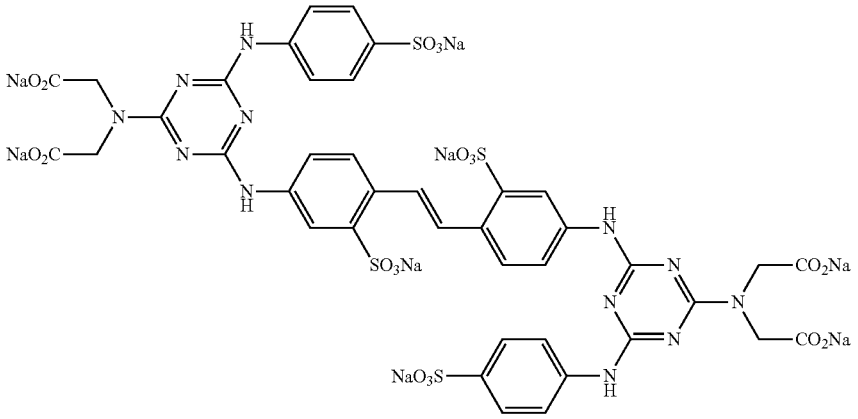

(3)

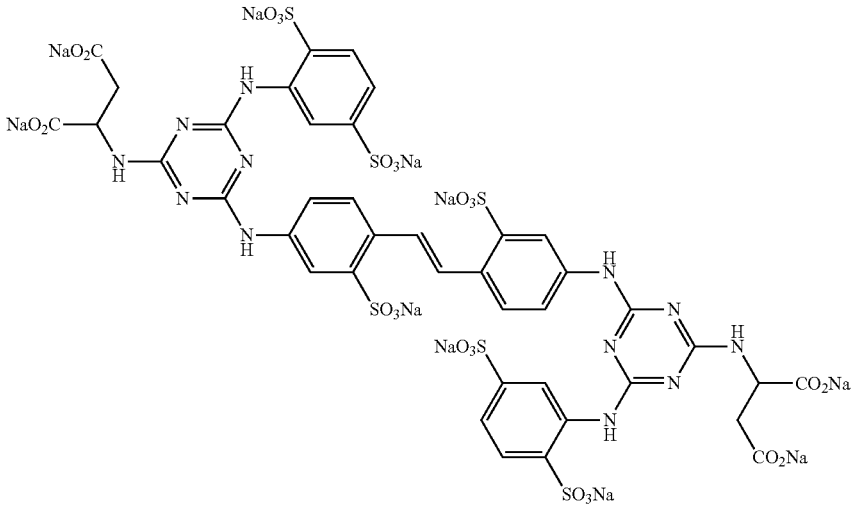

The magnesium salt can be, for example, magnesium acetate, magnesium bromide, magnesium chloride, magnesium formate, magnesium iodide, magnesium nitrate, magnesium sulphate or magnesium thiosulphate. Preferably, the magnesium salt is magnesium chloride, magnesium sulphate or magnesium thiosulphate. Most preferably, the magnesium salt is magnesium chloride.

Preferably, 0.15 to 10 parts of component (b) are present per part of component (a). Most preferably, 0.4 to 5 parts of component (b) are present per part of component (a).

For the treatment of paper in the size-press, sizing compositions containing 0.2 to 30, preferably 1 to 15 grams per liter of the optical brightener, may be used. The sizing composition also contains a binding agent in a concentration of preferably 2 to 15% by weight, based on the total weight of the sizing composition. The pH is typically in the range 5-9, preferably 6-8.

The binding agent or size is selected from the group consisting of native starch, enzymatically modified starch and chemically modified starch. Modified starches are preferably oxidized starch, hydroxyethylated starch or acetylated starch. The native starch is preferably an anionic starch, an cationic starch, or an amphoteric starch. While the starch source may be any, preferably the starch sources are corn, wheat, potato, rice, tapioca or sago. One or more secondary binders may be present, preferably polyvinyl alcohol or carboxymethylcellulose.

Further subject of the invention is a process for the optical brightening of paper comprising the steps of a) applying the sizing composition to the paper, b) drying the treated paper.

Preferably, a defoamer, a wax emulsion, a dye and/or a pigment is added to the sizing composition.

The following examples shall explain the instant invention in more details. If not indicated otherwise, "%" and "parts" are meant by weight.

EXAMPLE 1

Sizing compositions are prepared by adding an optical brightener of formula (2) in such an amount, that a range of final concentrations of from 2.5 to 12.5 g/l of optical brightener is achieved, to a stirred, aqueous solution of magnesium chloride (final concentration is 8 g/l) and an anionic oxidized potato starch (Perfectamyl A4692 from AVEBE B.A.) (final concentration is 50 g/l) at 60° C.

The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier. The dried paper is allowed to condition, then measured for CIE whiteness on a calibrated Elrepho spectrophotometer.

The Example is repeated both in the absence of magnesium chloride, i.e. only the sodium salt of the optical brightener is present, and with the magnesium chloride replaced by an equivalent amount of calcium chloride.

The results are summarized in Table 1, and clearly demonstrate the advantage of using magnesium chloride over the use of calcium chloride and over the use only of the sodium salt of the optical brightener in order to reach higher whiteness levels. The surprising nature of the invention is further illustrated by the observation that chloride salts of other divalent Group II metal ions, such as calcium chloride, even have a negative impact on the whitening effect of the optical brightener.

TABLE 1

| Optical Brightener (2) (g/l of actives) | Magnesium Chloride (g/l) | Calcium Chloride (g/l) | CIE Whiteness |
|---|---|---|---|
| 0 | 0 | 0 | 104.6 |
| 0 | 8 | 0 | 104.7 |
| 0 | 0 | 8 | 104.8 |
| 2.5 | 0 | 0 | 122.3 |
| 2.5 | 8 | 0 | 126.7 |
| 2.5 | 0 | 8 | 123.4 |
| 5.0 | 0 | 0 | 128.3 |
| 5.0 | 8 | 0 | 133.1 |
| 5.0 | 0 | 8 | 128.0 |
| 7.5 | 0 | 0 | 129.8 |
| 7.5 | 8 | 0 | 133.7 |
| 7.5 | 0 | 8 | 128.6 |
| 10.0 | 0 | 0 | 131.1 |
| 10.0 | 8 | 0 | 134.5 |
| 10.0 | 0 | 8 | 128.2 |
| 12.5 | 0 | 0 | 130.6 |
| 12.5 | 8 | 0 | 134.2 |
| 12.5 | 0 | 8 | 127.3 |

EXAMPLE 2

Sizing solutions are prepared by adding an optical brightener of formula (3) in such an amount, that a range of final concentrations of from 2.0 to 10.0 g/l of optical brightener is achieved, to a stirred, aqueous solution of magnesium chloride (final concentration is 8 g/l) and an anionic oxidized potato starch (Perfectamyl A4692 from AVEBE B.A.) (final concentration 50 g/l) at 60° C.

The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier. The dried paper is allowed to condition, then measured for CIE whiteness on a calibrated Elrepho spectrophotometer.

The Example is repeated both in the absence of magnesium chloride, and with the magnesium chloride replaced by an equivalent amount of calcium chloride.

The results are summarized in Table 2, and clearly demonstrate the advantage of using magnesium chloride to reach higher whiteness levels in comparison to where the optical brightener is present only as the sodium salt.

TABLE 2

| Optical Brightener (3) (g/l of actives) | Magnesium Chloride (g/l) | Calcium Chloride (g/l) | CIE Whiteness |
|---|---|---|---|
| 0 | 0 | 0 | 104.6 |
| 0 | 8 | 0 | 104.7 |
| 0 | 0 | 8 | 104.8 |
| 2.0 | 0 | 0 | 119.2 |
| 2.0 | 8 | 0 | 122.5 |
| 2.0 | 0 | 8 | 121.5 |
| 4.0 | 0 | 0 | 127.2 |
| 4.0 | 8 | 0 | 131.1 |
| 4.0 | 0 | 8 | 127.9 |
| 6.0 | 0 | 0 | 131.1 |
| 6.0 | 8 | 0 | 135.4 |
| 6.0 | 0 | 8 | 131.6 |
| 8.0 | 0 | 0 | 133.7 |
| 8.0 | 8 | 0 | 138.1 |
| 8.0 | 0 | 8 | 133.5 |
| 10.0 | 0 | 0 | 136.0 |
| 10.0 | 8 | 0 | 139.7 |
| 10.0 | 0 | 8 | 134.7 |

EXAMPLE 3

Sizing compositions are prepared by adding an optical brightener of formula (3) in such an amount, that a range of final concentrations of from 0 to 12.5 g/l of optical brightener is achieved, to stirred, aqueous solutions of magnesium chloride (final concentrations are 6.25 and 12.5 g/l) and an anionic oxidized corn starch (final concentration 50 g/l) (Penford Starch 260) at 60° C. Each sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier.

The dried paper is allowed to condition, and then measured for CIE whiteness on a calibrated Auto Elrepho spectrophotometer. The results are shown in Table 3.

EXAMPLE 4

Sizing compositions are prepared by adding an optical brightener of formula (3) in such an amount, that a range of final concentrations of from 0 to 12.5 g/l of optical brightener is achieved, to stirred, aqueous solutions of magnesium thiosulphate hexahydrate (final concentrations are 10 and 20 g/l) and an anionic oxidized corn starch (final concentration 50 g/l) (Penford Starch 260) at 60° C. The sizing solution is allowed to cool, then poured between the moving rollers of a laboratory size-press and applied to a commercial 75 g/m$^2$ AKD (alkyl ketene dimer) sized, bleached paper base sheet. The treated paper is dried for 5 minutes at 70° C. in a flat bed drier.

The dried paper is allowed to condition, and then measured for CIE whiteness on a calibrated Auto Elrepho spectrophotometer. The results are shown in Table 3.

TABLE 3

| | CIE Whiteness | | | | |
|---|---|---|---|---|---|
| | | Magnesium salt added | | | |
| Optical Brightener (3) (g/l of actives) | no Mg salt, i.e. Na salt only | Magnesium chloride (g/l) (example 3) | | Magnesium thiosulphate hexahydrate (g/l) (example 4) | |
| | | 6.25 | 12.5 | 10.0 | 20.0 |
| 0 | 102.8 | 102.9 | 103.5 | 102.2 | 102.7 |
| 2.5 | 119.6 | 122.4 | 125.5 | 125.1 | 123.6 |
| 5.0 | 128.9 | 131.1 | 132.5 | 132.9 | 132.7 |
| 7.5 | 135.1 | 136.3 | 137.9 | 137.7 | 137.9 |
| 10.0 | 139.2 | 140.9 | 141.4 | 141.1 | 141.0 |
| 12.5 | 141.1 | 142.3 | 142.8 | 142.4 | 142.4 |

The results clearly demonstrate the advantage of using magnesium chloride or magnesium thiosulphate to reach higher whiteness levels in comparison to where the optical brightener is present only as the sodium salt.

The invention claimed is:

1. A sizing composition for paper comprising (a) at least one optical brightener of formula (1)

(1)

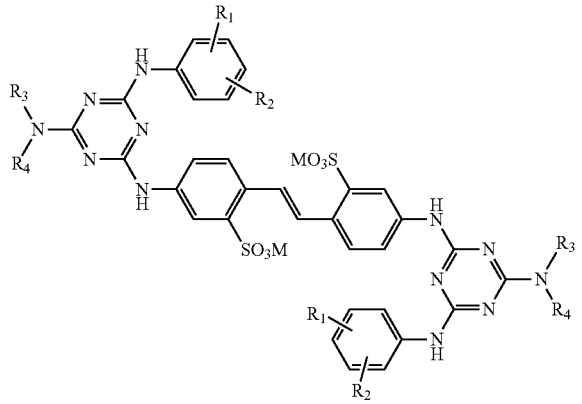

wherein $R_1$ is hydrogen or $SO_3M$, $R_2$ is hydrogen or $SO_3M$, $R_3$ is hydrogen, $C_{1-4}$alkyl, $C_{2-3}$hydroxyalkyl, $CH_2CO_2M$, $CH_2CH_2CONH_2$ or $CH_2CH_2CN$, $R_4$ is $C_{1-4}$alkyl, $C_{2-3}$hydroxyalkyl, $CH_2CO_2M$, $CH(CO_2M)CH_2CO_2M$, $CH(CO_2M)CH_2CH_2CO_2M$, benzyl, or $R_3$ and $R_4$ together with the neighboring nitrogen atom is a morpholine ring, and M is hydrogen, an alkali metal cation, ammonium, monomethyl-di-$C_2$-$C_3$-hydroxyalkyl ammonium, di-methyl-mono-$C_2$-$C_3$-hydroxyalkyl ammonium, ammonium which is mono-, di- or trisubstituted by a $C_2$-$C_3$ hydroxyalkyl radical, or mixtures thereof, (b) a magnesium salt, and (c) a binding agent, which is selected from the group consisting of native starch, enzymatically modified starch and chemically modified starch;

wherein 0.1 to 15 parts of component (b) is present per part of component (a).

2. A sizing composition according to claim 1, wherein $R_3$ is hydrogen, methyl, ethyl, n-propyl, isopropyl, β-hydroxyethyl, β-hydroxypropyl, $CH_2CO_2M$, $CH_2CH_2CONH_2$ or $CH_2CH_2CN$ and $R_4$ is methyl, ethyl, n-propyl, isopropyl, 2-butyl, β-hydroxyethyl, β-hydroxypropyl, $CH_2CO_2M$, $CH(CO_2M)CH_2CO_2M$, $CH(CO_2M)CH_2CH_2CO_2M$ or benzyl.

3. A sizing composition according to claim 1, wherein 0.15 to 10 parts of component (b) is present per part of component (a).

4. A sizing composition according to claim 1, wherein 0.4 to 5 parts of component (b) is present per part of component (a).

5. A sizing composition according to claim 1, wherein component (b) is magnesium acetate, magnesium bromide, magnesium chloride, magnesium formate, magnesium iodide, magnesium nitrate, magnesium sulphate or magnesium thiosulphate.

6. A sizing composition according to claim 1, wherein component (b) is magnesium chloride.

7. A sizing composition according to claim 1, wherein component (b) is magnesium thiosulphate.

8. A sizing composition according to claim 1, wherein the amount of binding agent present is from 2 to 15% by weight, based on the total weight of the sizing composition.

9. A sizing composition according to claim 1, wherein the amount of component (a) present is 0.2-30 g/l.

10. A sizing composition according to claim 1, wherein the amount of component (a) present is 1-15 g/l.

11. A sizing composition according to claim 1, wherein component (b) is magnesium sulphate.

12. A sizing composition according to claim 1, wherein the binding agent comprises a modified starch selected from the group consisting of oxidized starch, hydroxyethylated starch, or acetylated starch.

13. A sizing composition according to claim 1, wherein the binding agent comprises a native starch selected from the group consisting of an anionic starch, a cationic starch, or an amphoteric starch.

14. A process for the optical brightening of paper comprising the steps of a) applying the sizing composition according to claim 1 to the paper to form treated paper, b) drying the treated paper.

15. The process according to claim 14 comprising the additional step of adding a defoamer, wax emulsion, dye, pigment or a combination thereof to the sizing composition.

16. An optically brightened paper made in accordance with the process of claim 14.

17. A sizing composition for paper comprising (a) at least one optical brightener of formula (2)

(2)

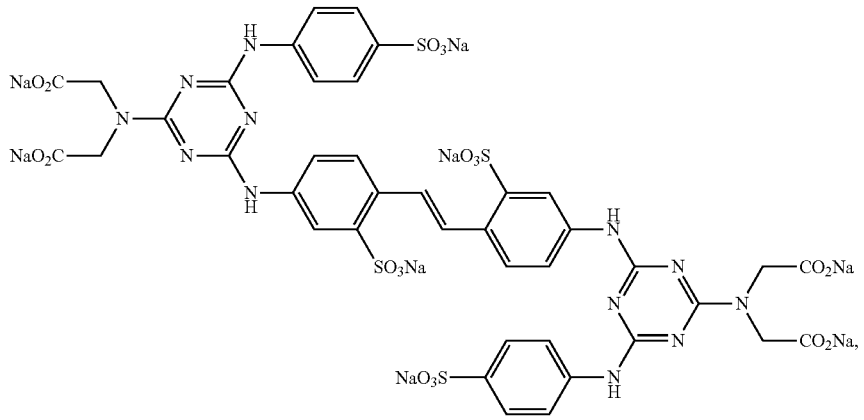

(b) a magnesium salt, and (c) a binding agent, which is selected from the group consisting of native starch, enzymatically modified starch and chemically modified starch;

wherein 0.1 to 15 parts of component (b) is present per part of component (a).

18. A sizing composition according to claim 17, wherein component (b) comprises magnesium chloride, and component (c) comprises an anionic oxidized potato starch.

19. A sizing composition for paper comprising (a) at least one optical brightener of formula (3)

(3)

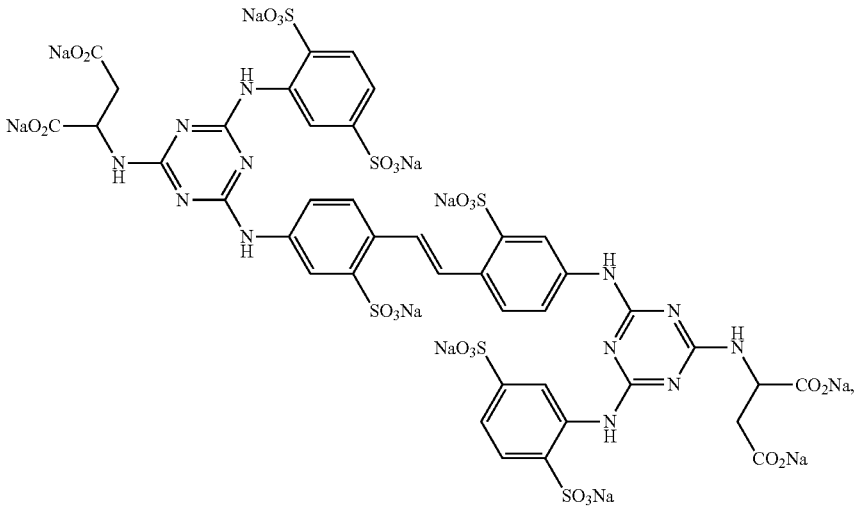

(b) magnesium chloride or magnesium thiosulphate, and (c) a binding agent, which is selected from the group consisting of native starch, enzymatically modified starch and chemically modified starch;

wherein 0.1 to 15 parts of component (b) is present per part of component (a).

20. A sizing composition according to claim 19, wherein component (b) comprises magnesium chloride or magnesium thiosulphate, and component (c) comprises an anionic oxidized potato starch or an anionic oxidized corn starch.

* * * * *